US006264593B1

(12) United States Patent
Newton, Jr. et al.

(10) Patent No.: US 6,264,593 B1
(45) **Date of Patent: *Jul. 24, 2001**

(54) PUNCH ASSEMBLY HAVING A POSITIVE PUNCH RETRACTION MECHANISM FOR AN INTERNAL DRUM IMAGESETTER

(75) Inventors: Arthur R. Newton, Jr., North Reading; Angelo Diramio, Medford; Thomas E. Robinson, Walpole, all of MA (US)

(73) Assignee: Agfa Corporation, Wilmington, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/240,984

(22) Filed: Jan. 29, 1999

(51) Int. Cl.[7] ..... B31B 1/88; B26D 7/06

(52) U.S. Cl. ..... 493/324; 493/363; 493/364; 83/127; 83/146

(58) Field of Search ..... 493/324, 340, 493/363, 364, 372, 472, 473; 83/124, 125, 127, 145, 146

(56) References Cited

U.S. PATENT DOCUMENTS 4,243,314 * 1/1981 Bowe et al. ..... 83/560
5,106,017 * 4/1992 Hicks ..... 234/1
5,291,647 * 3/1994 Fukasawa et al. ..... 83/552
5,487,634 * 1/1996 Vercillo ..... 412/16
5,628,502 * 5/1997 Amarakoon ..... 83/167
5,996,206 * 12/1999 Lynch et al. ..... 83/54

* cited by examiner

*Primary Examiner*—Eugene Kim
*Assistant Examiner*—Christopher Harmon
(74) *Attorney, Agent, or Firm*—William Hilton; Robert A. Sabourin

(57) ABSTRACT

A punch assembly is provided with a positive retraction mechanism to remove the punch from the media to be punched, thereby preventing binding of the punch in the media. The punch assembly includes a driving mechanism to provide a driving force on the punch and a positive retraction mechanism disposed to provide a retraction force on the punch operative sequentially following operation of the driving mechanism. The punch assembly, which is of a smaller size and more economical to manufacture, is particularly useful with an imagesetter of a prepress printing system. The punch may be mounted in a cantilever manner to punch the opening as close to the edge of the media as possible without interfering with the laser beam of the imaging assembly. In this maimer, the area of media available for imaging may be maximized and media waste minimized. Additionally, a shaft support mechanism is provided for the shaft upon which the retraction mechanism for each punch is mounted. When the punches advance into the media, an oppositely directed force is placed on the shaft. The shaft support mechanism supports the shaft when it is so loaded by the punches, thereby minimizing deflection of the shaft and allowing use of a smaller diameter shaft. Other equipment, such as take-up rollers which are used to transfer the media may also be fixed to the punch assembly. Similarly, a cutter assembly which cuts sheets of the media may also be fixed to the punch assembly.

21 Claims, 8 Drawing Sheets

PUNCH ASSEMBLY HAVING A POSITIVE PUNCH RETRACTION MECHANISM FOR AN INTERNAL DRUM IMAGESETTER

BACKGROUND OF THE INVENTION

In electronic prepress systems, images to be printed by offset printing are scanned from photographic sources, digitized, assembled, and edited electronically at a workstation. The images are then transmitted to a raster image processor (RIP) for half-tone screening and image rasterization. The RIP image, or rasterized image, to be printed is then transmitted from the RIP to an imagesetter for photographic or film recording onto a medium such as paper, film, or a printing plate.

An imagesetter includes a supply of unexposed photosensitive media, a recording support surface, and an image exposing system for forming the image to be recorded according to the RIP image data. The image exposing system may employ a laser beam, a cathode ray tube (CRT), an LED emitter, or the like as a radiation source. The media passes either as single sheets or from a supply roll as a web to the recording support surface at which point the photosensitive media is exposed by the radiation source, forming a latent image on the media. Numerous images may be recorded on the web consecutively. The exposed web is then advanced for transfer to a media processor where chemical processing occurs.

Three inks, yellow, magenta, and cyan, are used to print color images. Often black ink is also used. The links are printed in small dots, sometimes overlaid, in varying amounts to create the desired colors when viewed. Thus, three or four black and white separation films must be imaged, one for each color.

In the printing process, the films are overlaid and must be aligned accurately to ensure a good quality image. Toward this end, registration openings or holes are punched in each film to serve as an alignment guide. The location of each pixel on each film is determined with respect to the registration openings.

In prior art punch assemblies, the leading edge of the media is fed into a punch assembly, also referred to as a head punch assembly, in the imagesetter. The punches are forced through the media and held while the media is imaged. After imaging, the punches are retracted from the media. In prior art punch assemblies, the punches arc biassed toward the retracted position by a spring mechanism. Upon release of the punching force, which must be sufficient to overcome the spring bias force, the spring mechanism causes the punch to retract. The spring mechanism, however, has been found to permit binding of the punches in the media.

SUMMARY OF THE INVENTION

The present invention provides a head punch assembly having a positive retraction mechanism which prevents binding of the punch in the media. The punch assembly includes a driving mechanism to provide a driving force on the punch and a positive retraction mechanism disposed to provide a retraction force on the punch operative sequentially following operation of the driving mechanism. The punch assembly is of a smaller size and more economical to manufacture and is particularly useful with an internal drum imagesetter of a prepress printing system. The punch assembly includes a punch which may be mounted in a cantilever maimer to punch the opening as close to the edge of the media as possible without interfering with the laser beam of the imaging assembly. In this manner, the area of media available for imaging may be maximized and media waste minimized.

Another feature of the present invention is the provision of a roller support mechanism for the shaft upon which punch actuating mechanisms for each punch are mounted. When the punches push into the media, an oppositely directed force is placed on the shaft. The roller support mechanism supports the shaft when it is so loaded by the punches, thereby allowing use of a smaller diameter shaft and minimizing deflection of the shaft.

In another aspect of the present invention, the take-up roller assembly which is used to advance the media from the imagesetter may be mounted to the punch assembly. Similarly, the cutter assembly which cuts sheets of the media may also be mounted to the punch assembly. The assembly thereby takes up less space.

BRIEF DESCRIPTION OF THE DRAWINGS

The invention will be more fully understood from the following detailed description taken in conjunction with the accompanying drawings in which.

DETAILED DESCRIPTION OF THE INVENTION

Figure 1:
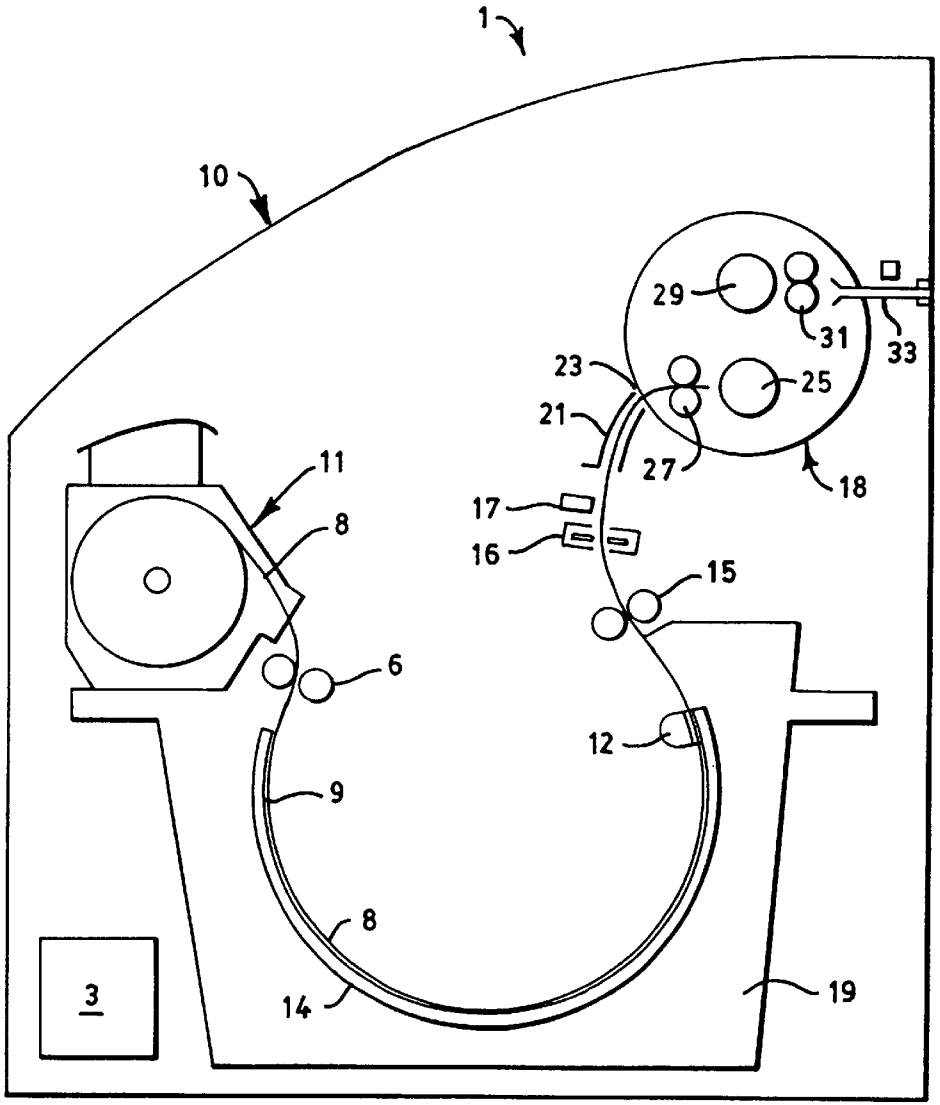
FIG. 1 is a schematic view which illustrates the media path through an imagesetter which includes a punch assembly according to the present invention.
Figure 2:
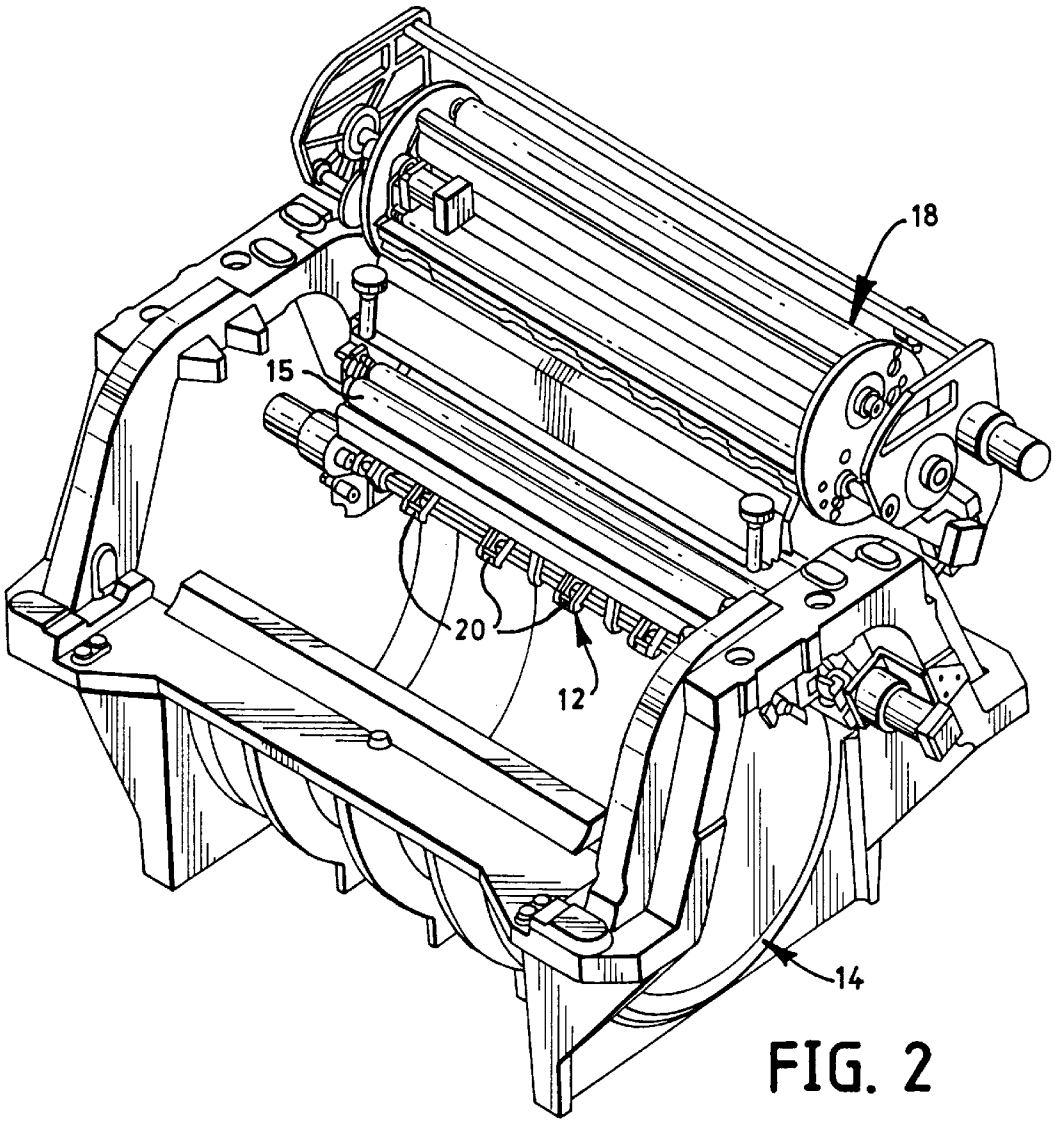
FIG. 2 is a perspective view of selected components of the imagesetter of FIG. 1, particularly illustrating the position of the head punch assembly on the internal drum.
Figure 3:
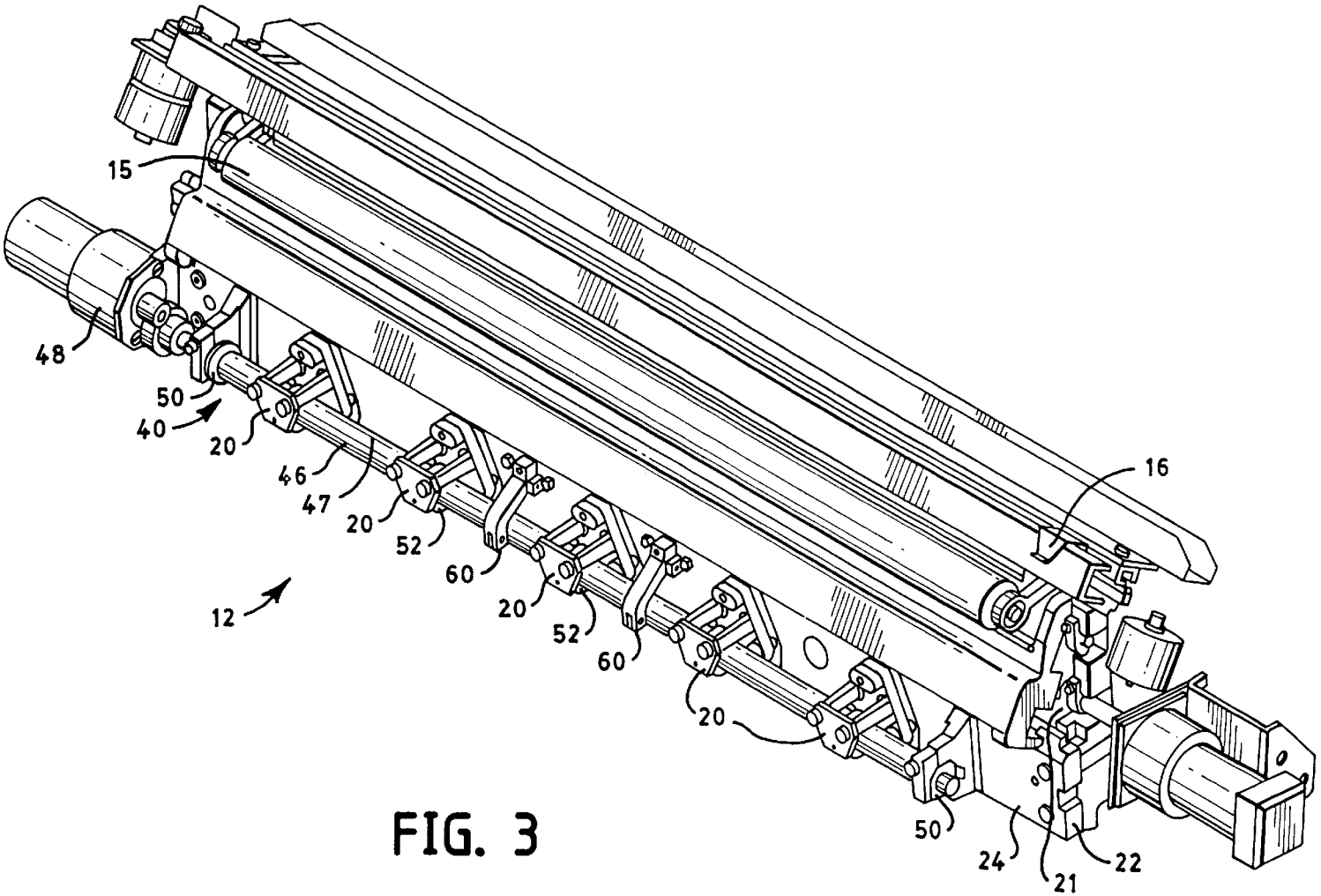
FIG. 3 is a detailed perspective view of the head punch assembly of FIG. 2.

FIG. 1 schematically depicts selected portions of an electronic pre-press system including an internal drum imagesetter 10 with a punch assembly 12 according to the present invention. The imagesetter includes a media supply cassette 11 which supplies a photosensitive media 8 as a web. Alternatively, the web supply roll 11 may be replaced by a source of precut sheets of media. A drum 14 is mounted to a drum support or frame 19. A leading edge of the media 8 resident in the media supply cassette 11 is drawn onto the internal drum surface 9 of the drum 14 via a drum input roller assembly 6 until the leading edge of the media is detected by a sensor 17. A laser imaging system (not shown for clarity) transfers and records an image onto the media resident within the drum. The laser imaging system typically includes a laser diode located at or near the main central axis of rotation of the drum on a carriage that allows translation along the drum axis. The output beam from the laser diode is scanned by a rotating mirror across the media on surface 9 in successive circumferentially extending bands or paths referred to as scan lines. The laser diode output beam exposes specific pixel locations of the media along those scan lines to form the desired image. Because the imaged media is associated with a single color component of the image, the laser diode is turned on or off for those pixel locations that contain that color component and depending on whether a positive or negative image is be generated.

After imaging, the media is transferred from the drum 14 to a transfer buffer 18 via a drive roller assembly 15. The media is transferred through a media path from the drum, which in this example is defined as the media path traversing from the roller assembly 15 to an opening 23 between platens 21. After a predetermined length of the media 8 passes by the sensor 17, a cutter assembly 16 cuts the media. The sheet of cut, imaged media entering the transfer buffer 18 is taken up into a first storage device 25 and continues to be drawn into the buffer 18 by drive rollers 27 until the trailing edge (not shown) of the sheet is in the vicinity of the opening 23. Another strip of media is drawn into the drum 14 by the roller assembly 6 until the leading edge is again detected by the sensor 17. The transfer buffer 18 is capable of taking in one sheet of media onto the storage device 25 and feeding out a previously stored sheet of media from additional storage device 29 via rollers 31 through platens 33. The buffer 18 is mounted to rotate such that the storage device 25 is subsequently positioned to allow the sheet of media to be fed out of the buffer 18 through the platens 33. Although two storage devices 25 and 29 are shown, any desired number of storage devices may be provided. The operations of the imagesetting system are controlled by a preinstalled software program in the controller 3.

Referring more particularly to FIGS. 2 through 4D, the punch assembly 12 comprises a number of punch mechanisms 20 mounted to a stationary support 22 including a support plate 24 and spaced across the width of the media oath. The stationary support may be fixedly mounted to the drum support 19 of the imagesetter. The number and location of the punch mechanisms 20 are determined by the particular application and may accordingly vary. Each punch mechanism includes a punch 26 which is forced through the media to form the registration opening.

In operation, the leading edge of the media is fed into the punch assembly under the support plate 24. The feeding stops, and the punch mechanisms 20 are actuated to drive the punches through the media. The punches remain in the media while imaging occurs. After imaging, the punches are actuated to positively retract them from the media. The media then is advanced by the roller assembly 15 for transfer to the buffer 18 and cut across its width by the cutter assembly 16.

Figure 4A:
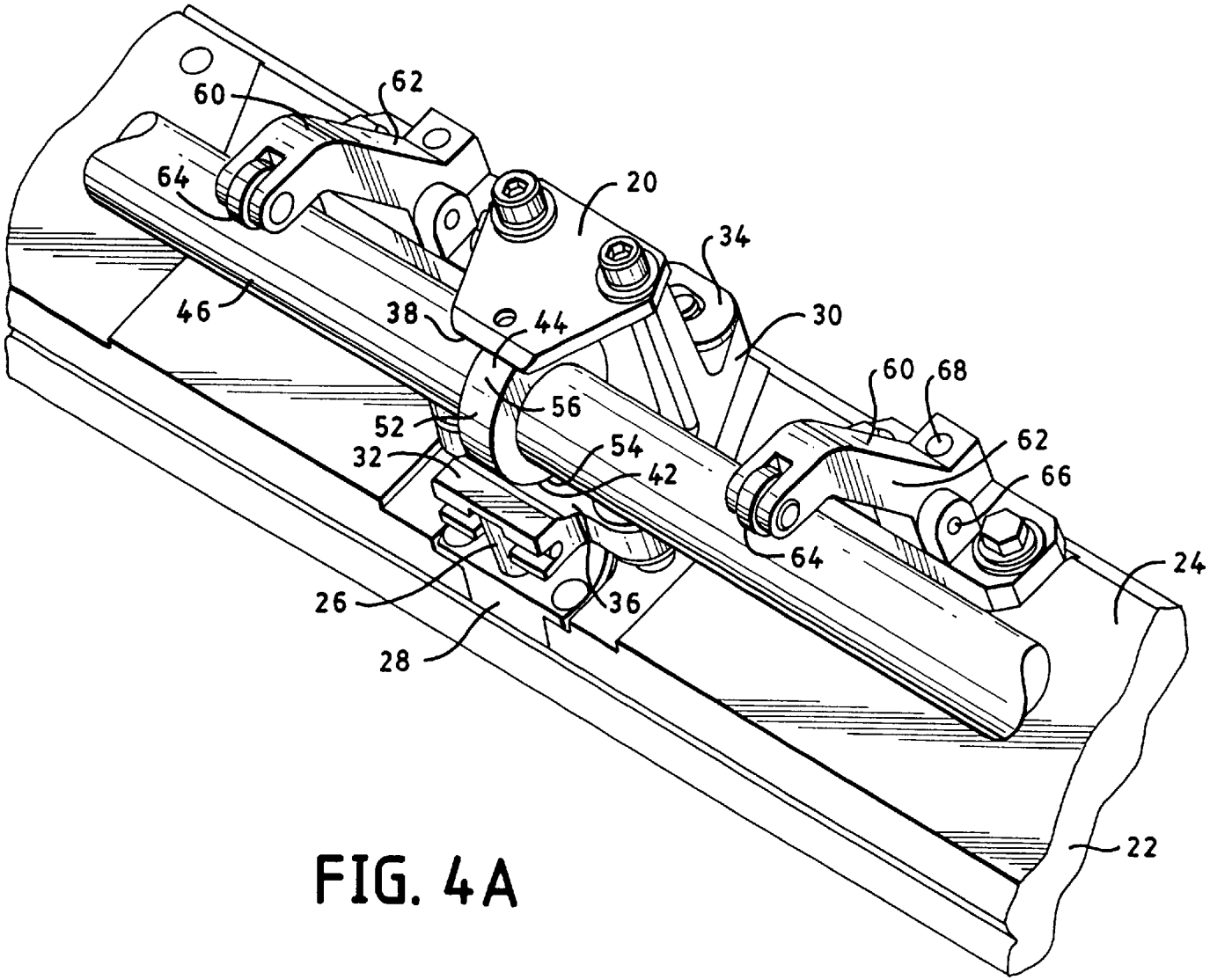
FIG. 4A is a detailed top perspective view of one punch of the punch assembly of FIG. 3.
Figure 4C:
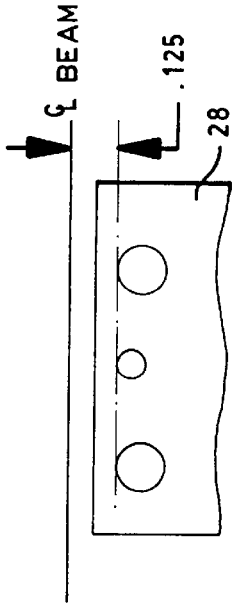
FIG. 4C is a diagrammatic view illustrating the pictorial relationships between a laser beam and holes punched into a media in accordance with the principles of the present invention.
Figure 4B:
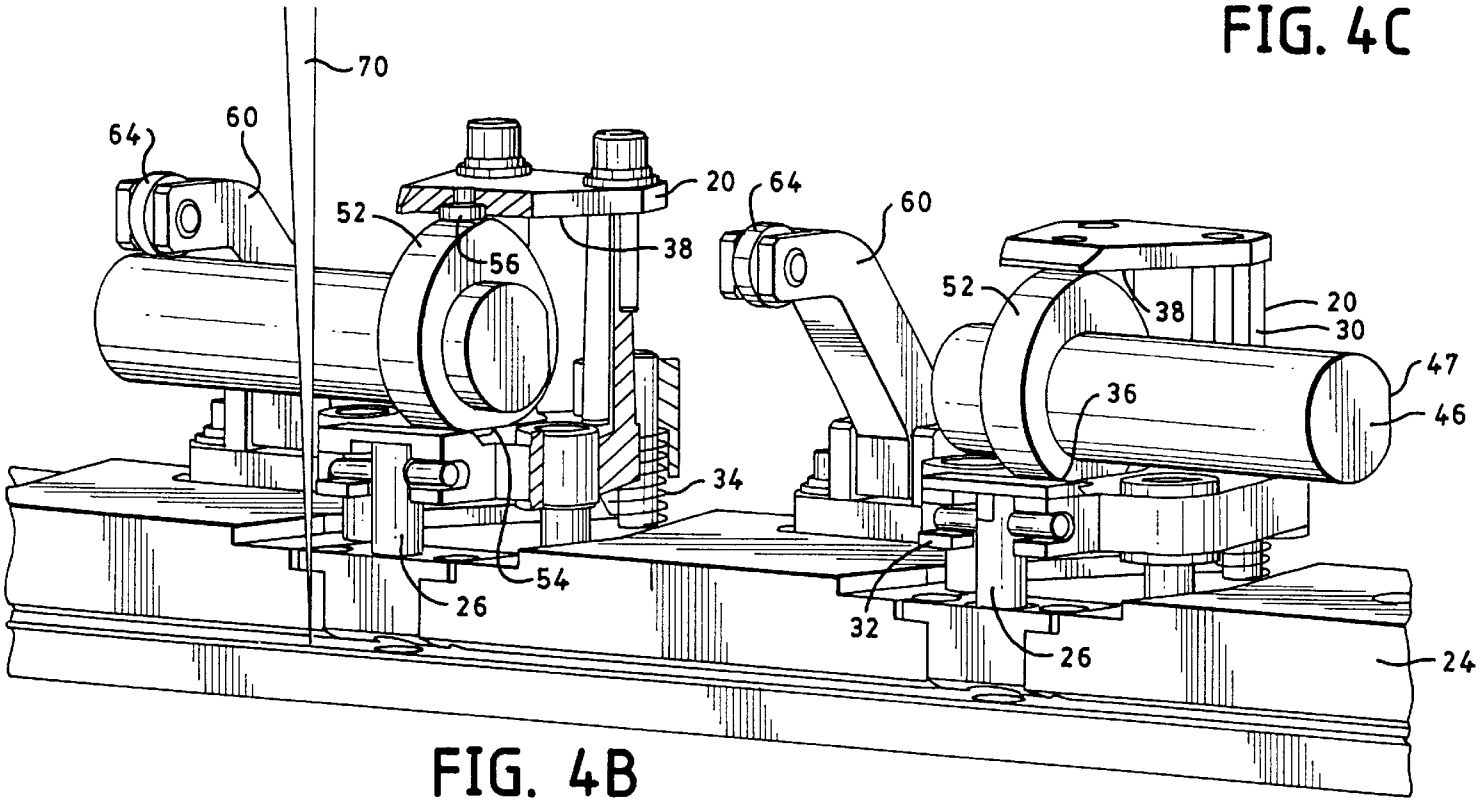
FIG. 4B is a detailed cutout front perspective view of one punch of the punch assembly of FIG. 3.
Figure 4D:
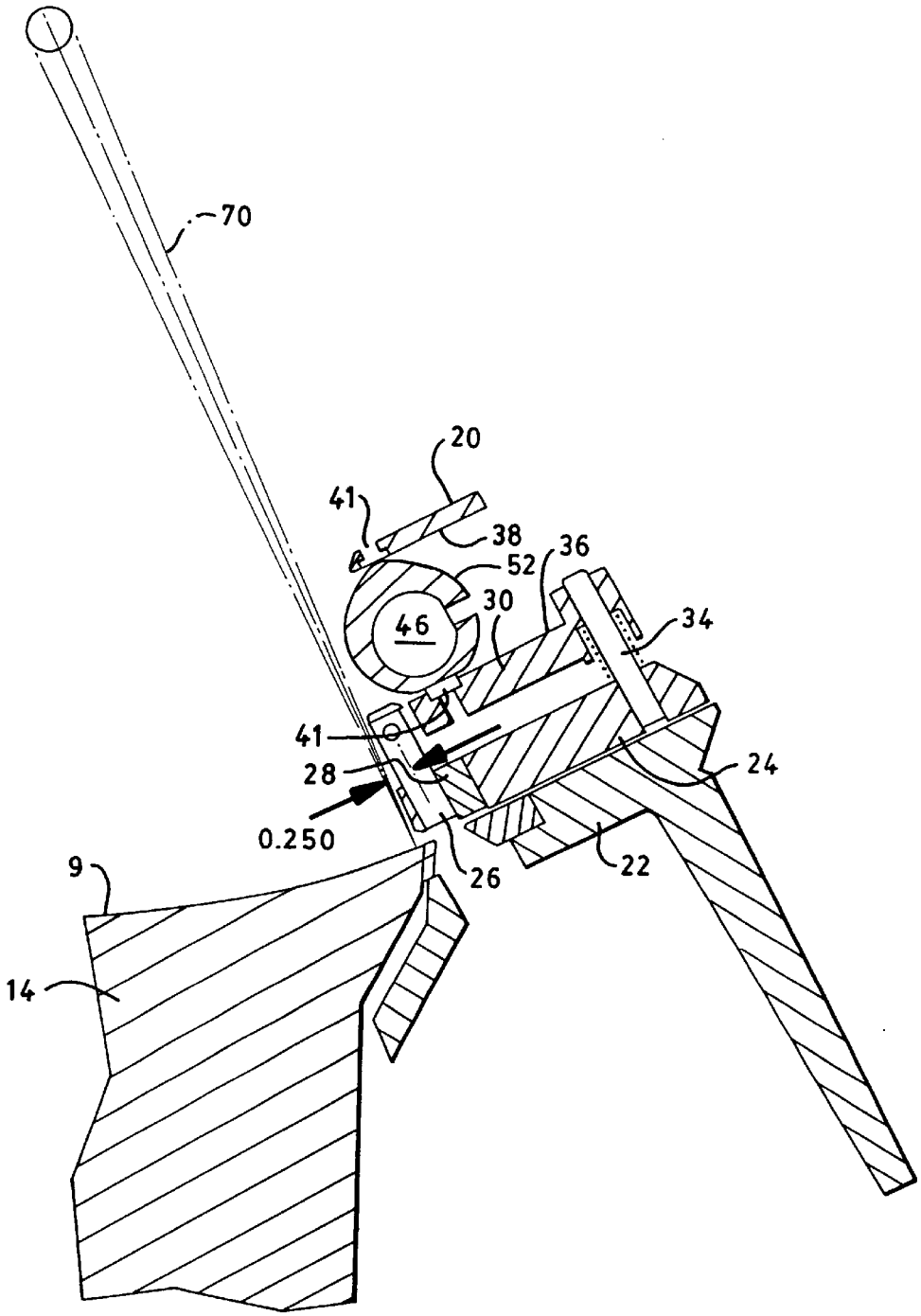
FIG. 4D is a cross-sectional view taken along a plane perpendicular to the longitudinal axis of the internal drum of FIG. 2, illustrating selected components of the head punch assembly.

Each punch mechanism comprises a punch 26, as noted above, and a punch guide 28 having an opening therethrough, with which the punch is aligned for linear reciprocal motion therethrough. The punch 26 is mounted in a cantilever manler, to allow the punch to form the registration opening as close to the edge of the media as possible without interfering with the imaging of the media by the laser diode output beam 70. As indicated in FIG. 4C, the edge of the punch 26 may lie 0.125 inch from the center line of the laser beam on the media. As indicated in FIG. 4D, in the preferred embodiment, the center line of the punch 26 is 0.250 inch from the center line of the laser beam. In this manner, the area of the sheet of media available for imaging is maximized and waste of the media is minimized.

In the preferred embodiment, for example, the punch 26 is fixed to a punch carrier 30 by brackets 32 on the punch carrier. The punch carrier 30 is linearly movable to provide the reciprocating linear motion of the punch 26 within the opening in the punch guide 28 perpendicularly toward and away from the media. The punch carrier 30 is mounted to the stationary support plate 24 in any suitable manner which permits suitable linear motion of the punch, such as by a spring stabilizer mechanism 34. The punch mechanism also includes a driving cam follower surface 36 and a retracting calm follower surface 38, which form components of a punch driving mechanism 42 and a positive punch retraction mechanism 44, respectively, described further below.

The punch assembly also includes a punch actuating mechanism 40. In the preferred embodiment, the punch actuating mechanism includes a shaft 46 mounted for rotation, preferably to the stationary support 22. A motor and gear assembly 48 may be provided to drive the rotation of the shaft in accordance with instructions from the controller 3. The shaft may be supported in any suitable manner, such as with bearings 50 near or at the ends. A cam member 52 is fixedly mounted to the shaft for rotation with the shaft. For example, the shaft may include a flat 47 which corresponds to a flat on the cam member. The cam member includes a punch driving face 54, which serves as a component of the punch driving mechanism 42, and a punch retracting face 56, which serves as a component of the positive punch retraction mechanism 44. To drive the punch 26 into the media, the shaft 46 is rotated in a first direction. The punch driving face 54 of the cam member 52 strikes the driving cam follower surface 36 of the punch mechanism, thereby providing a force on the punch toward the media. In this maimer, the punch is forced into the media, forming the registration opening. To retract the punch from the media, the shaft 46 is rotated in a direction opposite to the first direction. The punch retracting face 56 of the cam member 52 strikes the retracting cam follower surface 38 of the punch mechanism, thereby providing a force on the punch away from the media. In this manner, the punch is retracted from the media. The positive retraction provided by this mechanism eliminates or minimizes binding of the punch in the media. The driving cam follower surface 36 and the retracting cam follower surface 38 may each include a bearing insert 41 made from a suitable bearing material, such as nylon, upon which the faces of the cam member bear. It will also be appreciated that, although the cam member 52 is shown as a single element having two cam faces, separate cam elements each providing one of the cam faces could be provided.

During manufacture, the punch mechanisms 20 may be located in any desired locations across the width of the media path. Any suitable number of punch mechanisms may be provided. The locations and number of punch mechanisms are determined by the particular application. The punch mechanisms are fixed on the stationary support plate 24 relative to the shaft so that their positions cannot be altered in the field. In this manner, the location of and spacing between punches can be controlled to within the desired tolerance and this tolerance can be maintained in the field, thereby ensuring that the location and spacing of the registration openings are consistent with repeated uses of the imagesetter. The punch mechanism can be fixed to the stationary support and relative to the shaft in any suitable manner. For example, a recess may be machined in the stationary support plate 26 to receive the punch guide 28. The punch guide 28 may be fixed to the stationary support with screws or other suitable fasteners.

The punches 26 of a single punch assembly 12 may be of different cross-sectional configurations. For example, the punches may be circular, oval, rectangular, etc. The punches may have different diameters or other cross-sectional dimensions. The particular cross sections are determined by the particular application. Also, the length of each punch differs from the lengths of the other punches. Typically, the lengths become progressively greater from one end to the other. In this manner, all the punches are actuated at the same time by rotation of the shaft; however, each punch penetrates the media at a different time. In this way, the media is not loaded by all the punches simultaneously. The punches could also be independently actuated if desired.

The preferred embodiment of the present invention also provides one or more shaft support mechanisms 60 for the shaft 46. As the punch 26 is driven into the media by the cam member 52 acting on the driving cam follower surface 36, the punch carrier 30 provides an equal but oppositely directed force on the cam member 52 and hence on the shaft 46. One or more of the shaft support mechanisms 60 are provided along the length of the shaft. Preferably two such shaft supports are provided, symmetrically located about a center point of the shaft, between two punch mechanisms or surrounding a centrally located punch mechanism. It will be appreciated, however, that the shaft support mechanisms may be disposed at other locations along the shaft. Similarly, any other desired number of shaft support mechanisms may be utilized.

The shaft support mechanism 60 comprises an arm 62 fixed to the stationary support 22. A shaft contact or bearing element 64 is mounted on an end of the arm to extend above an upper portion of the shaft. The shaft contact element is accordingly also fixed in position relative to the stationary support 22. As the shaft experiences a force in a direction away from the media by action of the punch mechanism on the cam member, the shaft 46 abuts against the shaft contact element 64. The shaft contact element prevents deflection of the shaft above the location defined by the shaft contact element. In this manner, the shaft support mechanism of the present invention allows utilization of a smaller diameter shaft. The shaft contact element may be formed from any bearing material, such as nylon, suitable for contact with a metal.

The shaft contact element preferably is formed by a freely rotating roller bearing. The freely rotating roller bearing allows the shaft to rotate unimpeded. Other suitable contact elements which also allow unimpeded rotation of the shaft may be used, such as a flat or curved bearing surface.

The arm may be adjustable so that, during manufacture, the position of the contact element 64 can be set to contact the shaft. For example, in the embodiment shown, the arm 62 is pivotable about a pin 66, and a set screw 68 is provided to set the limit of upward rotation of the arm. It should be noted that, although the shaft contact element is typically in continuous contact with the shaft, continuous contact is not necessary as long as the deflection of the shaft is maintained at a suitable minimum to prevent overstraining and failure of the shaft.

In another aspect of the present invention, the take-up roller assembly 21 which is used to advance the media from the imagesetter 10 may be mounted to the support 22 of the punch assembly. Similarly, the cutter assembly 23 which cuts the media across its width may also be mounted to the support 22 of the punch assembly. The assembly thereby takes up less space.

Figure 5:
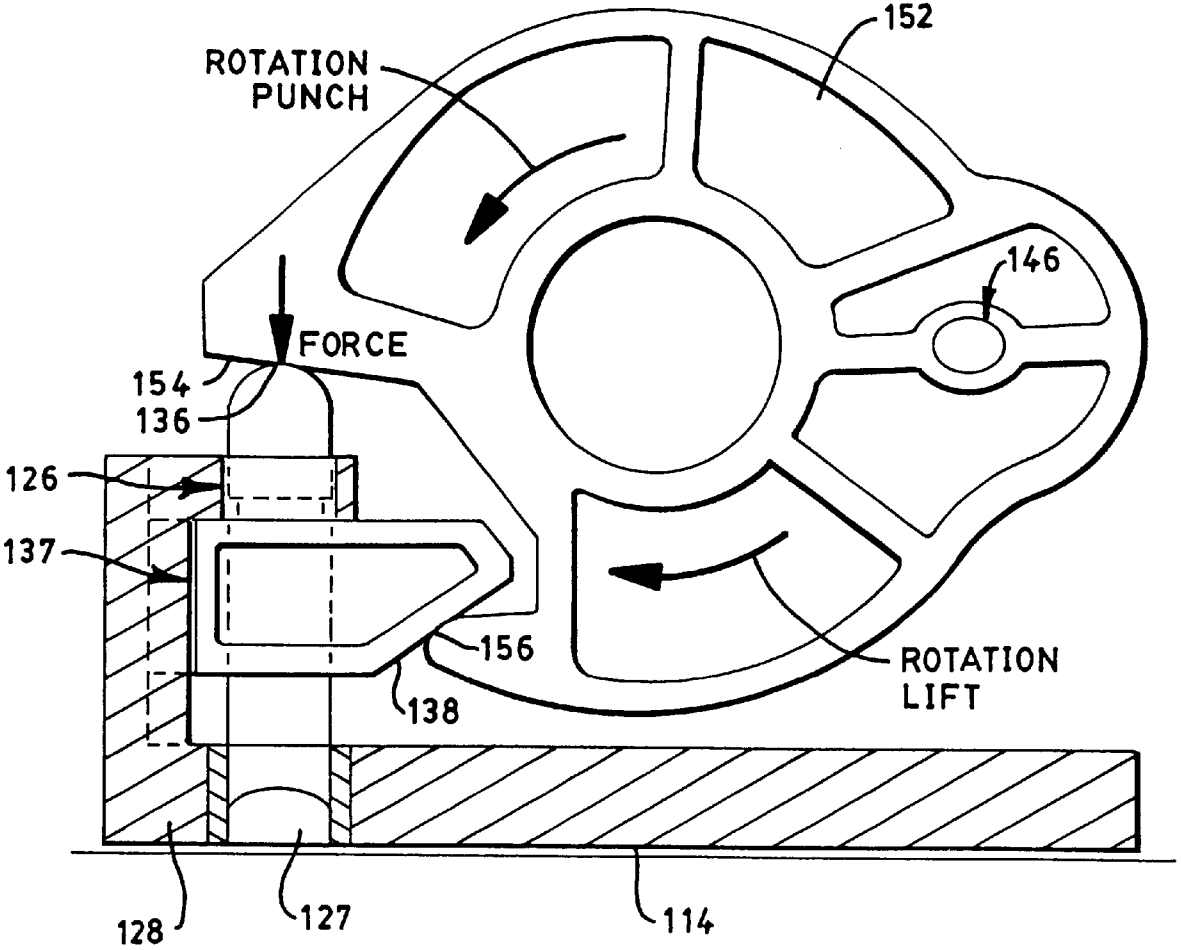
FIG. 5 is a side view of a further embodiment of a punch assembly according to the present invention.

A further embodiment of the present invention is illustrated in FIG. 5. In this embodiment, a cam member 152 is mounted for rotation on a shaft 146. The cam member includes a punch driving face 154 which is in contact with an upper surface 136 of a punch 126. As the cam member is rotated in a first direction, the punch driving face 154 forces the punch 126 through an opening 127 in a punch guide 128 into the media 114, which is held by the punch guide. One or more and preferably a pair of brackets 137 are fixedly mounted to the punch 126 on either side of the punch. Each bracket has a surface 138 which abuts against a punch retracting face 156 of the cam member 152. When rotation of the cam is reversed, the punch retracting face forces the brackets upwardly, thereby positively retracting the punch from the media.

Figure 7:
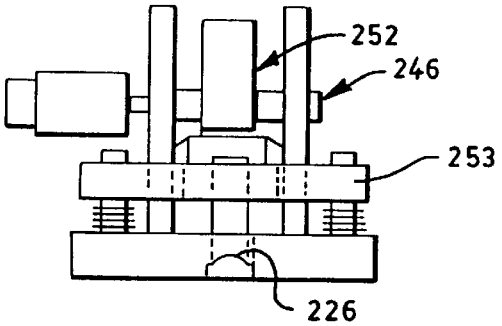
FIG. 7 is a side view of the multiple punch mechanism of FIG. 5.
Figure 6:
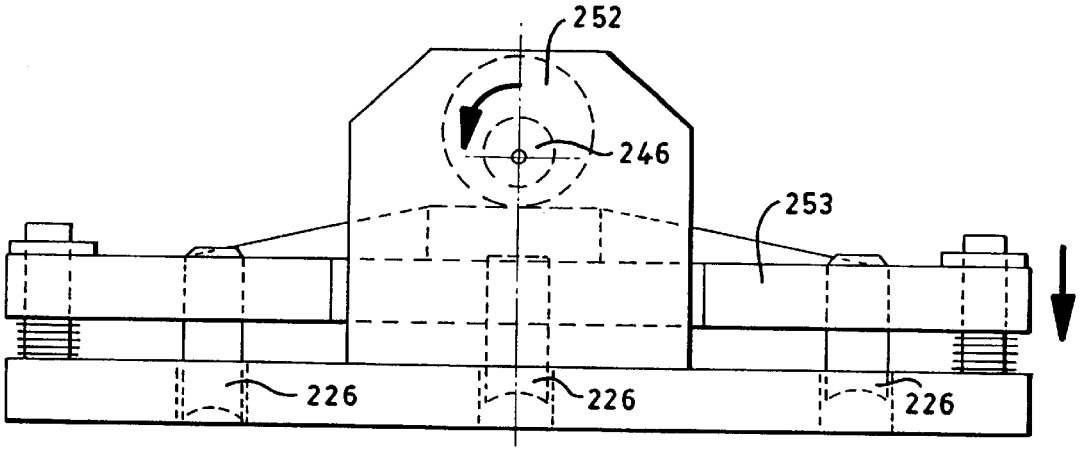
FIG. 6 is a schematic view of a further embodiment of a multiple punch mechanism according to the present invention.

In another embodiment, illustrated in FIGS. 6 and 7, a single cam member 252 may be provided to generate a driving force on a balanced punching plate 253 with multiple punches 226. As illustrated in FIGS. 6 and 7, the cam member is mounted for rotation about a shaft 246 which is oriented at right angles to the orientation of the shaft 46 described above in conjunction with FIGS. 2 through 4D. It will be appreciated that the particular orientation of the rotation axis and design of the cam faces may vary depending, for example, on space requirements of the application. It will also be appreciated that a positive retraction mechanism (not shown in FIGS. 5 and 6) may be provided in accordance with the present invention.

While the invention has been particularly described in conjunction with an imagesetter for an electronic prepress printing system, the punch assembly and shaft support mechanism may be applicable to other types of equipment in which registration openings must be punched in sheets of media. Similarly, although illustrated as located at the exit area, the punch assembly could be located at the entrance area if desired for a suitable application. The invention is not to be limited by what has been particularly shown and described, except as indicated by the appended claims.

What is claimed is:

1. A punch assembly for punching one or more openings into a sheet of imageable media in an image setter, comprising:

a punch mechanism comprising a punch and a punch guide having an opening therethrough for receiving the punch, the punch disposed for linear motion within the opening and into the sheet of imageable media located below the opening; and a punch actuating mechanism comprising:

a driving mechanism rotatable in a first direction disposed to contact and provide a driving force at a first driving face of the punch to drive the punch within the opening in the punch guide through the sheet of imageable media and to hold the punch in the sheet of imageable media for a predetermined period of time sufficient for the sheet of imageable media to be imaged, and a positive retraction mechanism rotatable in a second direction that is opposite said first direction disposed to contact and provide a retraction force at a second driving face of the punch to retract the punch from the sheet of imageable media, the positive retraction mechanism operative sequentially following operation of the driving mechanism.

2. The punch assembly of claim 1, wherein the first driving face of the punch is disposed on an end of an elongated portion of the punch.

3. The punch assembly of claim 1, wherein the second driving face of the punch is disposed on a bracket member that extends from the elongated portion of the punch in a direction that is transverse to the elongated portion.

4. The punch assembly of claim 3, wherein the punch includes a pair of bracket members.

5. The punch assembly of claim 1, wherein the driving mechanism is a cam member mounted for rotation about an axis.

6. The punch assembly of claim 1, wherein the positive retraction mechanism is a cam member mounted for rotation about an axis.

7. The punch assembly of claim 1, wherein the punch actuating mechanism includes a cam member fixedly mounted to a rotatable shaft and an actuator for rotating the shaft about the shaft's axis.

8. The punch assembly of claim 7, further comprising a shaft support mechanism disposed to provide a counteracting force on the shaft in response to a deflecting force exerted on the shaft by the punch mechanism during a punch operation.

9. The punch assembly of claim 8, wherein the shaft support mechanism comprises a shaft contact element disposed to contact the shaft on a side of the shaft opposite the punch mechanism at a predetermined location, whereby deflection of the shaft is limited by the shaft contact element.

10. A punch assembly for punching one or more openings in a sheet of imageable media in an imaging system, comprising:

a punch mechanism comprising a punch and a punch guide having an opening therethrough for receiving the punch, the punch disposed for linear motion within the opening and through the sheet of imageable media located below the opening;

means for rotating in a first rotational direction, and for contacting and providing a driving force at a first driving face of the punch to push the punch in a first linear direction within the opening in the punch guide into the sheet of imageable media and to hold the punch in the sheet of imageable media for a predetermined period of time sufficient for the imageable media to be imaged;

means for rotating in a second rotational direction that is opposite said first rotational direction, and for contacting and providing a retraction force at a second driving face of the punch to push the punch in a second linear direction opposite said first linear direction to retract the punch from the sheet of imageable media sequentially following operation of the means for providing a driving force.

11. The punch assembly of claim 10, wherein the first driving face of the punch is disposed on an end of an elongated portion of the punch.

12. The punch assembly of claim 10, wherein the driving mechanism is a cam member mounted for rotation about an axis.

13. The punch assembly of claim 10, wherein the positive retraction mechanism is a cam member mounted for rotation about an axis.

14. The punch assembly of claim 10, wherein the punch actuating mechanism includes a cam member fixedly mounted to a rotatable shaft and an actuator for rotating the shaft about the shaft's axis.

15. The punch assembly of claim 10, wherein the second driving face of the punch is disposed on a bracket member that extends from the elongated portion of the punch in a direction that is transverse to the elongated portion.

16. The punch assembly of claim 15, wherein the punch includes a pair of bracket members.

17. A punch assembly for punching one or more openings into a sheet of imageable media in an image setter, comprising:

a punch mechanism comprising a punch and a punch guide having an opening therethrough for receiving the punch, the punch disposed for linear motion within the opening and into the sheet of imageable media located below the opening; and a punch actuating mechanism comprising:

a driving mechanism rotatable in a first direction disposed to provide a driving force at an end of an elongated portion of the punch to push the punch against a first pushing surface on the punch and within the punch guide through the sheet of imageable media and to hold the punch in the sheet of imageable media for a predetermined period of time sufficient for the sheet of imageable media to be imaged, and a positive retraction mechanism rotatable in a second direction that is opposite said first direction disposed to contact and provide a retraction force at a retraction face that is disposed on a bracket member that extends from the elongated portion of the punch in a direction that is transverse to the elongated portion to push the punch from the sheet of imageable media, the positive retraction mechanism operative sequentially following operation of the driving mechanism.

18. The punch assembly of claim 17, wherein the punch includes a pair of bracket members.

19. The punch assembly of claim 17, wherein the driving mechanism is a cam member mounted for rotation about an axis.

20. The punch assembly of claim 17, wherein the positive retraction mechanism is a cam member mounted for rotation about an axis.

21. The punch assembly of claim 17, wherein the punch actuating mechanism includes a cam member fixedly mounted to a rotatable shaft and an actuator for rotating the shaft about the shaft's axis.

* * * * *